US009835170B2

(12) United States Patent
Kabasawa et al.

(10) Patent No.: US 9,835,170 B2
(45) Date of Patent: Dec. 5, 2017

(54) VACUUM PUMP WITH FIBER-REINFORCED RESIN CYLINDER

(71) Applicants: EDWARDS JAPAN LIMITED, Yachiyo-shi, Chiba (JP); ARISAWA MFG. CO., LTD., Joetsu-shi, Niigata (JP)

(72) Inventors: Takashi Kabasawa, Chiba (JP); Yuichi Kawai, Joetsu (JP); Masaki Hori, Joetsu (JP); Takahiro Iiyoshi, Joetsu (JP)

(73) Assignees: EDWARDS JAPAN LIMITED, Yachiyo-shi, Chiba (JP); ARISAWA MFG. CO., LTD., Joetsu-shi, Niigata (JP)

( * ) Notice: Subject to any disclaimer, the term of this patent is extended or adjusted under 35 U.S.C. 154(b) by 673 days.

(21) Appl. No.: 14/358,248

(22) PCT Filed: Nov. 28, 2012

(86) PCT No.: PCT/JP2012/080775
§ 371 (c)(1),
(2) Date: May 15, 2014

(87) PCT Pub. No.: WO2013/081019
PCT Pub. Date: Jun. 6, 2013

(65) Prior Publication Data

US 2014/0294565 A1 Oct. 2, 2014

(30) Foreign Application Priority Data

Nov. 30, 2011 (JP) ..... 2011-261793

(51) Int. Cl.
*F04D 29/52* (2006.01)
*F04D 19/04* (2006.01)
*F04D 29/02* (2006.01)

(52) U.S. Cl.
CPC ..... *F04D 29/526* (2013.01); *F04D 19/04* (2013.01); *F04D 19/044* (2013.01);
(Continued)

(58) Field of Classification Search
CPC ..... F04D 29/526; F04D 19/04; F04D 19/044; F04D 29/023
(Continued)

(56) References Cited

U.S. PATENT DOCUMENTS 3,966,523 A * 6/1976 Jakobsen ..... B29D 22/00 156/169
3,969,812 A * 7/1976 Beck ..... B21D 51/24 220/590
(Continued)

FOREIGN PATENT DOCUMENTS

GB 2420379 A * 5/2006 ..... F04D 19/044
JP 07004383 A 1/1995
(Continued)

OTHER PUBLICATIONS

International Search Report of PCT/JP2012/080775, dated Feb. 26, 2013.
(Continued)

*Primary Examiner* — Jason Shanske
*Assistant Examiner* — Jason T Newton
(74) *Attorney, Agent, or Firm* — Sughrue Mion, PLLC

(57) ABSTRACT

Provided is a vacuum pump in which the flexing of a rotating cylinder made of a fiber-reinforced resin can be reduced as much as possible to sufficiently reduce the gap between the rotating cylinder and a fixed cylinder, and exhaust performance can thereby be improved to great effect. A vacuum pump comprising a thread groove pump portion equipped with a fixed cylinder portion (2) having a spiraling thread groove portion (1) provided in an internal peripheral surface,
(Continued)

and a rotating cylinder portion (3) placed inside the fixed cylinder portion (2), the thread groove pump portion exhausting through a spiraling exhaust flow channel due to the rotating cylinder portion (3) being caused to rotate, and the exhaust flow channel being formed from the thread groove portion (1) and an external peripheral surface of the rotating cylinder portion (3). The rotating cylinder portion (3) is configured by stacking a plurality of fiber-reinforced resin layers, and the outermost fiber-reinforced resin layer is thicker than the adjacent layer.

15 Claims, 7 Drawing Sheets

(52) U.S. Cl.
CPC ..... *F04D 29/023* (2013.01); *F05D 2230/10* (2013.01); *F05D 2300/43* (2013.01); *F05D 2300/44* (2013.01); *F05D 2300/6034* (2013.01)

(58) Field of Classification Search
USPC ..... 415/90
See application file for complete search history.

(56) References Cited

U.S. PATENT DOCUMENTS 4,773,306 A * 9/1988 Dirkin ..... F15B 11/0365 92/151
H001261 H * 12/1993 Gibson ..... B29C 53/845 156/169
5,285,699 A * 2/1994 Walls ..... B29D 99/0046 74/572.12
5,316,611 A * 5/1994 Moser ..... B65H 54/64 156/425
5,415,079 A * 5/1995 Ching ..... B29C 63/10 92/169.2
5,772,395 A * 6/1998 Schofield ..... F04D 19/046 415/188
5,822,838 A * 10/1998 Seal ..... B21D 51/24 156/172
6,261,699 B1 * 7/2001 Ress, Jr. ..... C22C 47/20 428/292.1
6,343,910 B1 * 2/2002 Kawasaki ..... F04D 19/046 415/177
6,361,635 B1 * 3/2002 Ayorinde ..... B29C 53/602 156/169
6,779,969 B2 * 8/2004 Nonaka ..... F04D 19/046 415/143
7,037,865 B1 * 5/2006 Kimberly ..... B29C 70/60 264/103
2003/0000336 A1 * 1/2003 Tsai ..... B29C 70/025 74/572.12
2003/0095860 A1 * 5/2003 Takamine ..... F04D 19/04 415/90
2004/0076510 A1 * 4/2004 Favre-Felix ..... F04D 29/023 415/90
2009/0257889 A1 * 10/2009 Shi ..... F04D 19/042 417/244
2011/0281061 A1 11/2011 Nakamura et al.
2013/0309076 A1 * 11/2013 Nonaka ..... F04D 19/042 415/200
2015/0030475 A1 * 1/2015 Mekota ..... F04D 25/02 417/355
2015/0184669 A1 * 7/2015 Kabasawa ..... F04D 19/044 428/141

FOREIGN PATENT DOCUMENTS

JP 3098139 B2 10/2000
JP 2001-221186 A 8/2001
JP 2004-278512 A 10/2004
JP 2005180265 A 7/2005
JP 2009-108752 A 5/2009

OTHER PUBLICATIONS

English Translation of International Preliminary Report on Patentability for PCT/JP2012/080775 dated Jun. 12, 2014.
Communication dated Jun. 25, 2015, issued by the European Patent Office in corresponding European Application No. 12854483.0.

* cited by examiner

VACUUM PUMP WITH FIBER-REINFORCED RESIN CYLINDER

CROSS REFERENCE TO RELATED APPLICATIONS

This application is a National Stage of International Application No. PCT/JP2012/080775 filed Nov. 28, 2012, claiming priority based on Japanese Patent Application No. 2011-261793, filed Nov. 30, 2011, the contents of all of which are incorporated herein by reference in their entirety.

TECHNICAL FIELD

The present invention relates to a vacuum pump comprising a thread groove pump portion.

BACKGROUND ART

A compound turbo-molecular pump used in order to achieve a high vacuum environment in a vacuum device has a thread groove pump composed of a rotating cylinder and a fixed cylinder facing the rotating cylinder, the thread groove pump being provided downstream of an axial flow pump made by alternately disposing rotating blades and fixed blades.

In this thread groove pump, the smaller the gap is between the opposing rotating cylinder and fixed cylinder, the more the exhaust performance is improved, and high precision is therefore required in the rotating cylinder portion constituting the thread groove pump.

Therefore, the rotating cylinder portion is normally made of metal and is cut integrally with the rotating blades, but there have been proposals of replacing the rotating cylinder portion with an FRP (fiber-reinforced resin) cylinder that is lightweight and high in strength in order to reduce the weight of the rotating body having the rotating blades and the rotating cylinder (see Patent Documents 1 and 2, for example).

PRIOR ART DOCUMENTS

[Patent Documents]
[Patent Document 1] JP-A 2009-108752
[Patent Document 2] JP-A 2004-278512

DISCLOSURE OF THE INVENTION

Problems the Invention is Intended to Solve

Because the rotating body rotates at a high speed, a load is applied in the circumferential direction. Because the rotating cylinder has a structure fixed only at one end to a rotating shaft, a load is applied not only in the circumferential direction but in the axial direction as well.

In view of this, it is common for the FRP rotating cylinder to have a multilayer structure in which hoop layers containing a circumferential arrangement of fibers and helical layers containing an axial arrangement of fibers at a slight angle are alternately stacked. It is also common in this case to make the layers as thin as possible and to increase the number of layers in order to average the material characteristics of the rotating cylinder.

However, in the case of the multilayer structure described above, irregularities form in the surface due to overlapping of the fibers in the helical layers, slight positional misalignment when the fibers are wound, and the like.

Therefore, after the rotating cylinder is molded by winding the fibers usually so that the outermost layer is a hoop layer, the irregularities in the surface must be removal-machined and finished to a predetermined shape precision.

Removal machining (finishing machining) the irregularities in the surface causes internal stress nonuniformity due to the release of internal strain and causes the entire rotating cylinder to flex, thereby causing a problem in that the gap with the opposing fixed cylinder cannot be sufficiently reduced.

This is presumably because: the FRP rotating cylinder is formed from at least two materials (fibers and a resin); the hoop layers and the helical layers, which are layers of different fiber orientations, are integrated; and there is great internal strain due to the flexing of the material due from setting contraction when the resin sets and the difference in thermal expansion coefficients.

From another standpoint, removal machining (finishing machining) the surface irregularities causes the rotating cylinder to deform due to:

A) cutting of continuous fibers;

B) undoing of flexing balance between an anisotropic material layer and another anisotropic material layer; and C) change tension on the fibers of predetermined portions of the layers. Even if the fibers are not cut, when a resin layer in a certain part is cut out, the flexing balance is undone and the rotating cylinder sometimes deforms.

From another standpoint, the FRP is an anisotropic material different from isotropic materials such as iron, and the material characteristics differ between the hoop layers and the helical layers. In the FRP, when the hoop layers and the helical layers are set in a single setting step (i.e., not a method of first setting only the hoop layers and then setting only the helical layers, but stacking and winding the hoop layers and helical layers in a winding step, and simultaneously and integrally setting the hoop layers and helical layers), the helical layers and hoop layers are balanced and the rotating cylinder is maintained. Therefore, the rotating cylinder deforms greatly when this balance is undone. In other words, when part of the hoop layers or helical layers is cut machined and the fibers are cut, or when the resin layer is cut out without cutting the fibers, the stress balance in the rotating cylinder is undone and the shape of the rotating cylinder cannot be maintained.

The present invention is intended to resolve the problems described above, and an object thereof is to provide a vacuum pump in which the flexing of a rotating cylinder made of a fiber-reinforced resin can be reduced as much as possible to sufficiently reduce the gap between the rotating cylinder and a fixed cylinder, and exhaust performance can thereby be improved to great effect.

Means for Solving these Problems

A summary of the present invention is described with reference to the accompanying drawings.

The present invention relates to a vacuum pump comprising a thread groove pump portion equipped with a fixed cylinder portion 2 having a spiraling thread groove portion 1 provided in an internal peripheral surface, and a rotating cylinder portion 3 placed inside the fixed cylinder portion 2, the thread groove pump portion exhausting through a spiraling exhaust flow channel due to the rotating cylinder portion 3 being caused to rotate, and the exhaust flow channel being formed from the thread groove portion 1 and an external peripheral surface of the rotating cylinder portion 3; the vacuum pump being characterized in that the rotating cylinder portion 3 is configured by stacking a plurality of fiber-reinforced resin layers, and the outermost fiber-reinforced resin layer is configured to be thicker than an adjacent layer.

The present invention also relates to a vacuum pump according to the first aspect, characterized in that the outermost fiber-reinforced resin layer is configured to be at least 25% thicker than the adjacent layer.

The present invention a vacuum pump comprising a thread groove pump portion equipped with a fixed cylinder portion 2 having a spiraling thread groove portion 1 provided in an internal peripheral surface, and a rotating cylinder portion 3 placed inside the fixed cylinder portion 2, the thread groove pump portion exhausting through a spiraling exhaust flow channel due to the rotating cylinder portion 3 being caused to rotate, and the exhaust flow channel being formed from the thread groove portion 1 and an external peripheral surface of the rotating cylinder portion 3; the vacuum pump being characterized in that the rotating cylinder portion 3 is configured by stacking a plurality of fiber-reinforced resin layers, the fiber-reinforced resin layers include helical layers formed by a helical winding of fibers and hoop layers formed by a hoop winding of fibers, and the outermost hoop layer 5 is configured to be thicker than an adjacent layer.

The present invention also relates to a vacuum pump according to the third aspect, characterized in that the outermost hoop layer 5 is configured to be at least 25% thicker than the adjacent layer.

The present invention also relates to a vacuum pump according to the first aspect, characterized in that at least part of the surface of the rotating cylinder portion 3 is removed.

The present invention also relates to a vacuum pump according to the third aspect, characterized in that at least part of the surface of the rotating cylinder portion 3 is removed.

The present invention also relates to a vacuum pump according to the first aspect, characterized in that the outermost layer of the rotating cylinder portion 3 is a hoop layer 5.

The present invention also relates to a vacuum pump according to the third aspect, characterized in that the outermost layer of the rotating cylinder portion 3 is a hoop layer 5.

The present invention also relates to a vacuum pump according to the first aspect, characterized in that the innermost layer of the rotating cylinder portion 3 is a hoop layer 5.

The present invention also relates to a vacuum pump according to the third aspect, characterized in that the innermost layer of the rotating cylinder portion 3 is a hoop layer 5.

The present invention also relates to a vacuum pump according to the ninth aspect, characterized in that the hoop layers 5 of the outermost layer and innermost layer of the rotating cylinder portion 3 are equal to each other in thickness.

The present invention also relates to a vacuum pump according to the tenth aspect, characterized in that the hoop layers 5 of the outermost layer and innermost layer of the rotating cylinder portion 3 are equal to each other in thickness.

The present invention also relates to a vacuum pump according to the first aspect, characterized in that the other layers of the rotating cylinder portion 3 besides the outermost layer and innermost layer are set to be equal to each other in thickness.

The present invention also relates to a vacuum pump according to the third aspect, characterized in that the other layers of the rotating cylinder portion 3 besides the outermost layer and innermost layer are set to be equal to each other in thickness.

Effects of the Invention

Because the present invention is configured as described above, a vacuum pump is achieved in which flexing of a rotating cylinder made of a fiber-reinforced resin can be reduced as much as possible to sufficiently reduce the gap between the rotating cylinder and a fixed cylinder, and exhaust performance can thereby be improved to great effect.

BEST MODE FOR CARRYING OUT THE INVENTION

Figure 1:
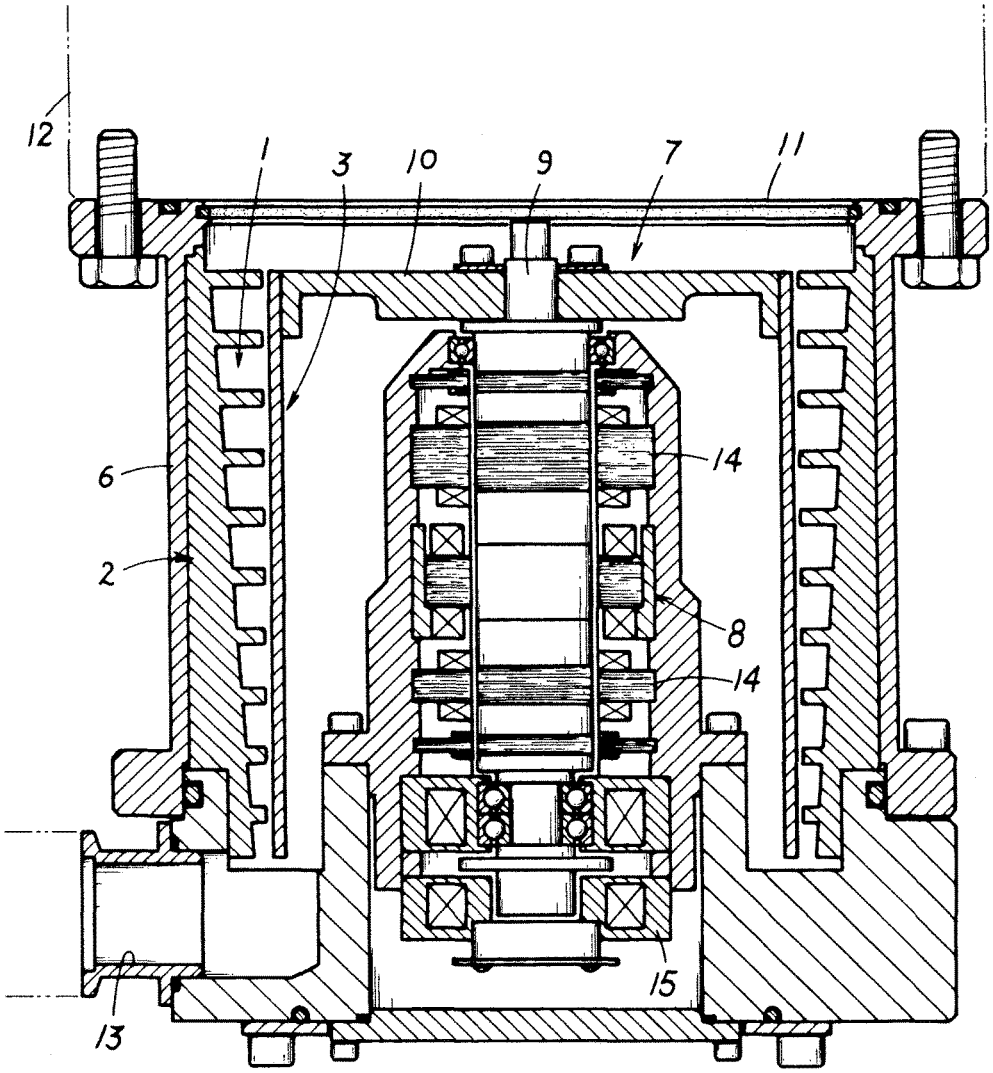
FIG. 1 is a schematic explanatory cross-sectional view of the present example.

Preferred embodiments of the present invention are described in a simple manner with reference to the diagrams while indicating the effects of the present invention.

By making an outermost fiber-reinforced resin layer (e.g., a hoop layer 5) thicker than an adjacent layer, it is possible to relatively reduce the nonuniformity of internal stress caused by the release of internal strain, which is caused by removal machining, and the flexing of a rotating cylinder portion 3 made of a fiber-reinforced resin is consequently reduced. It is also possible to relatively reduce the effects caused by cutting continuous fibers, the undoing of the flexing balance between an anisotropic material layer and another anisotropic material layer, and changes in tension on the fibers in predetermined portions of the layers, which are caused by removal machining; and the flexing of the rotating cylinder portion 3 made of a fiber-reinforced resin is consequently reduced.

EXAMPLES

Specific examples of the present invention are described with reference to the drawings.

The present example is a vacuum pump comprising a thread groove pump portion equipped with a fixed cylinder portion 2 having a spiraling thread groove portion 1 provided in the internal peripheral surface, and a rotating cylinder portion 3 placed inside the fixed cylinder portion 2, the thread groove pump portion exhausting through a spiraling exhaust flow channel due to the rotating cylinder portion 3 being caused to rotate, and the exhaust flow channel being formed from the thread groove portion 1 and an external peripheral surface of the rotating cylinder portion 3; the rotating cylinder portion 3 being configured by stacking a plurality of fiber-reinforced resin layers, the fiber-reinforced resin layers including helical layers 4 formed by a helical winding of fibers and hoop layers 5 formed by a hoop winding of fibers, and the outermost hoop layer 5 being configured so that the surface is removed and the outermost hoop layer 5 after the surface removal is thicker than the adjacent layer.

Specifically, the present example is a thread groove pump in which a rotating body 7 (a rotor) is rotatably disposed inside a tubular pump case 6, as shown in FIG. 1. The rotating body 7 is configured from a metal discoid attachment part 10 attached to a rotating shaft 9 of a DC motor 8, and a rotating cylinder portion 3 to which the attachment part 10 is connected in a fitted manner. In this drawing, the symbol 11 indicates an intake port communicated with a chamber 12, 13 indicates an exhaust port, 14 indicates a diametric electromagnet, and 15 indicates an axial electromagnet.

The outside diameter of the attachment part 10 and the inside diameter of the rotating cylinder portion 3 are substantially equal to each other, for example, and the attachment part 10 and the rotating cylinder portion 3 are connected in a fitted manner by "cold fitting" in which the attachment part 10 is fitted in an inserted manner in the top part of the rotating cylinder portion 3 while being cooled by liquid nitrogen or the like.

The rotating cylinder portion 3 of the present example is made by stacking a plurality of fiber-reinforced resins formed using conventional filament winding, and is formed by alternately stacking a plurality of helical layers 4 formed by a helical winding of fibers with a winding angle of 80° relative to the axial center of a mandrel, and hoop layers 5 formed by a hoop winding of fibers with a winding angle of 80° or more relative to the axial center of the mandrel.

Specifically, the rotating cylinder portion 3 of the present example is formed by alternately stacking helical layers 4 (winding angle ±20° relative to the axial center of the mandrel) and hoop layers 5 in three or more layers, including the configuration hoop layer/helical layer/hoop layer so that at least the innermost layer and outermost layer are hoop layers 5.

The helical layers 4 are provided in order to create resistance against force in the axial direction, and the hoop layers 5 are provided in order to create resistance against force in the circumferential direction. Because the flexing between layers is greater with thicker layers and fewer stacked layers, the flexing between layers can be reduced by increasing the number of stacked layers and reducing the thickness of the layers. The outermost layer and the innermost layer are not limited to hoop layers 5 and may be helical layers 4 or layers of only a resin, but the flexing of the rotating cylinder portion 3 can be reduced more by using hoop layers 5.

For example, the rotating cylinder portion 3 is formed by winding and stacking carbon fibers impregnated with a resin around a mandrel, alternately stacking the hoop layers 5 and the helical layers 4, thermosetting the resin, and removing the mandrel. The resin may be selected as appropriate for the application from resins such as a phenol resin, an unsaturated polyester resin, and an epoxy resin.

After the mandrel has been removed, the surface (the irregularities thereof) of the outermost layer of the rotating cylinder portion 3 is slightly ground (removal machining) in order to achieve a predetermined dimension (shape) in the outside diameter of the rotating cylinder portion 3.

The present example is configured such that the thickness of the outermost hoop layer 5 is greater than the thickness of the adjacent layer in order to reduce as much as possible the nonuniformity of internal stress caused by the release of internal strain, which is caused by the removal machining (finishing machining) of the irregularities in the surface. The present example is also configured such that the thickness of the outermost hoop layer 5 is greater than the thickness of the adjacent layer in order to reduce as much as possible the effects caused by cutting continuous fibers, the undoing of the flexing balance between an anisotropic material layer and another anisotropic material layer, and changes in tension on the fibers in predetermined portions of the layers, which are caused by the removal machining (finishing machining) of the irregularities in the surface. The other layers are set to be equal to each other in thickness.

Figure 2:
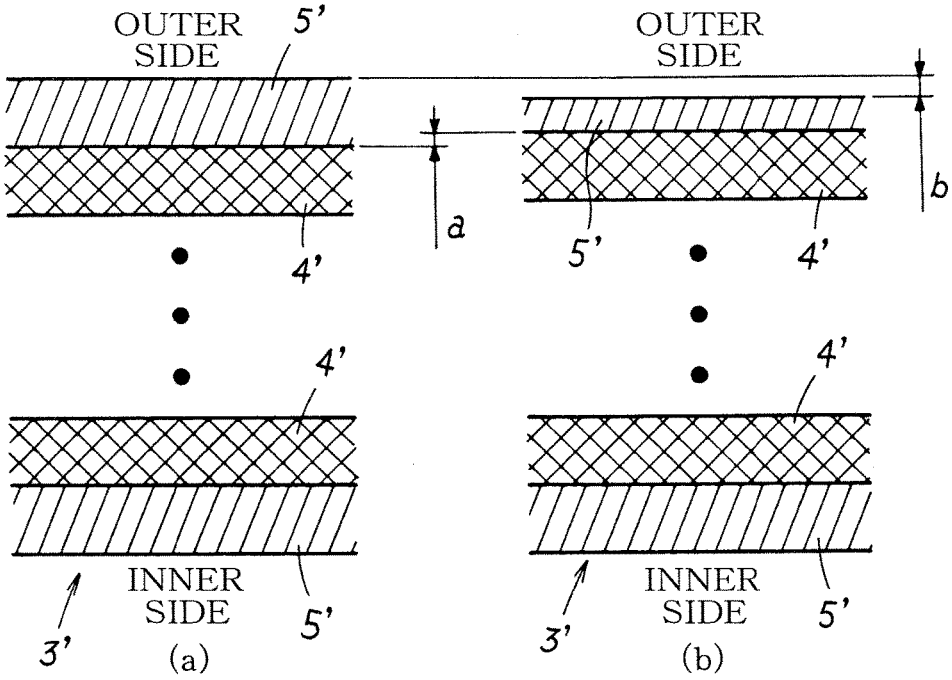
FIG. 2 RELATED ART
FIG. 2 is a schematic explanatory cross-sectional view of a conventional rotating cylinder portion.
Figure 3:
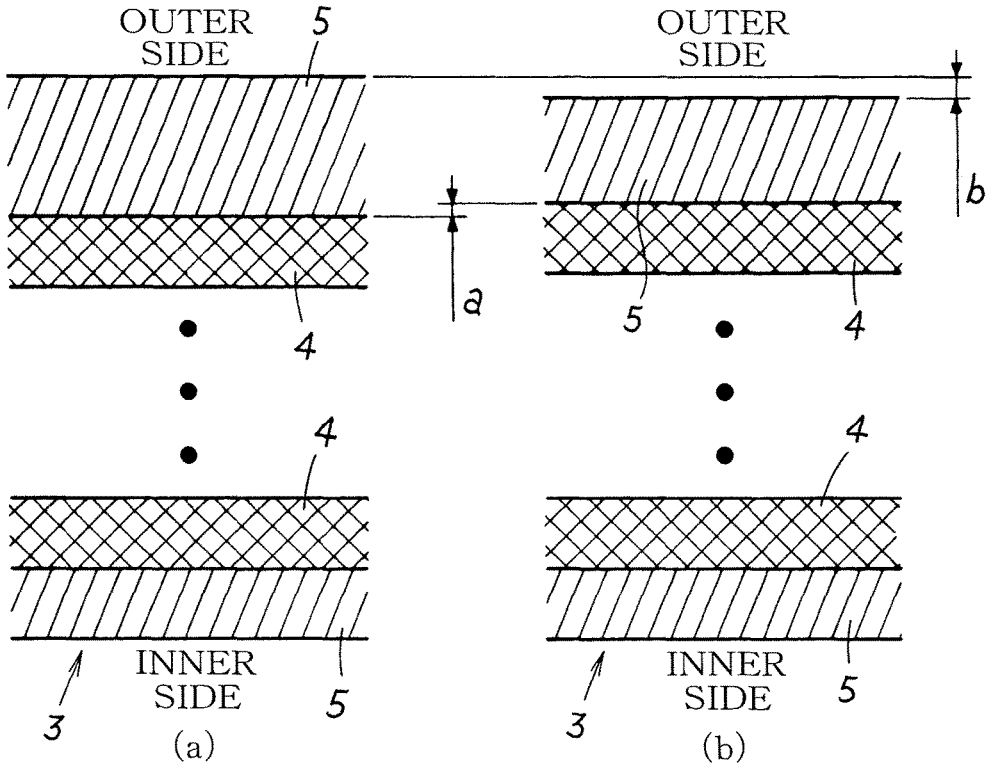
FIG. 3 is a schematic explanatory cross-sectional view the rotating cylinder portion of the present example

FIG. 2 shows when the outermost layer thickness is at a maximum (a) and at a minimum (b) in a conventional rotating cylinder portion 3' molded by filament winding so that the outermost layer and the other layers are equal to each other in thickness, and FIG. 3 shows when the outermost layer thickness is at a maximum (a) and at a minimum (b) in the rotating cylinder portion 3 of the present example molded by filament winding so that the outermost layer has the greatest thickness. In these drawings, the symbols 4' and 4 indicate helical layers, and 5' and 5 indicate hoop layers.

Figure 4:
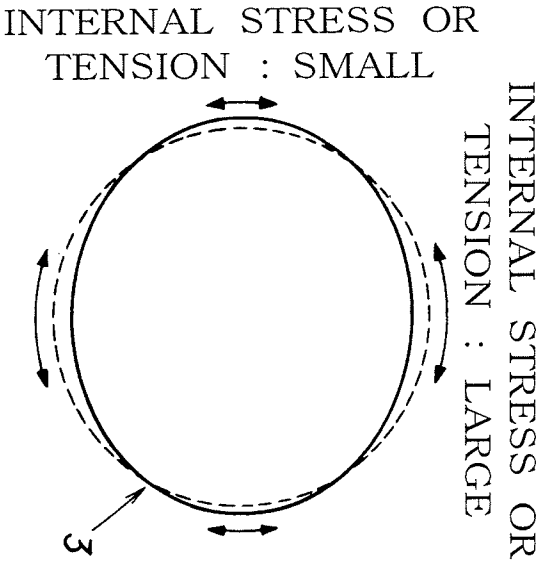
FIG. 4 is a schematic explanatory view showing an example of deformation caused by internal stress in the rotating cylinder portion or by a difference in tension on the fibers of predetermined portions of the layers.

It is clear from FIGS. 2 and 3 that when the cumulative difference a in thickness nonuniformity with the inside layers (inside layers excluding the outermost layer and the innermost layer) is at a maximum and the difference b in the amount of removal machining is at a maximum (the difference between pre-machining thickness and post-machining thickness in the thickness of the outermost layer is at a maximum), there is less of an effect from the change in thickness of the outermost layer in FIG. 3. FIG. 4 is an example of deformation caused by internal stress or the difference in tension on the fibers of predetermined portions of the layers, and a disparity in the difference b of the removal machining amounts arises in these portions because of this deformation.

When the outermost layer (the outermost hoop layer 5) has a small thickness after removal machining, there are cases in which this deformation has a great effect and the circularity of the rotating cylinder portion 3 is instead worse than before the removal machining. Therefore, the thickness of the outermost layer (the outermost hoop layer 5) is preferably as thick as possible in order to reduce the difference in internal stress or tension on the fibers of predetermined portions of the layers as previously described.

Figure 7:
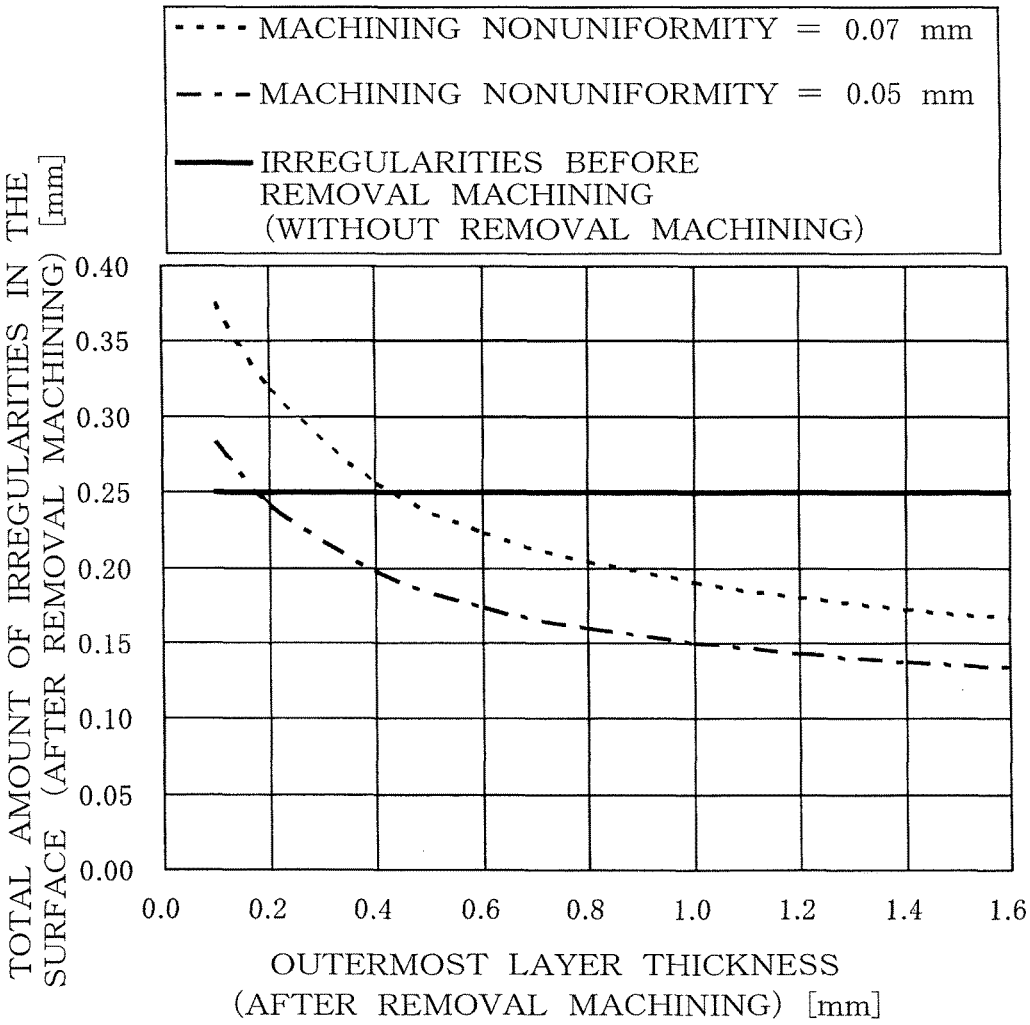
FIG. 7 is a graph showing the results of simulating the thickness of the outermost layer (the outermost hoop layer) and the amount of irregularities in the surface after removal machining.

The relationship between the thickness of the outermost layer (the outermost hoop layer 5) and the amount of irregularities in the surface before and after removal machining is as shown in FIG. 7, for example.

In the example of FIG. 7, irregularities of 0.25 mm form in the surface before removal machining due to overlapping of the fibers in the helical layers, slight positional misalignment when the fibers are wound, and the like. Removal machining is performed in order to take out these irregularities, but even if irregularities caused by fiber overlapping or the like are taken out, machining nonuniformity sometimes causes nonuniformity in internal stress due to the release of internal strain, and the entire cylinder flexes greatly. Machining nonuniformity also sometimes causes cutting of continuous fibers, undoing of the flexing balance between an anisotropic material layer and another anisotropic material layer, and changes in the tension on the fibers of predetermined portions of the layers, and the entire cylinder flexes. Furthermore, cutting the fibers in the cylinder made of a fiber-reinforced resin after the resin has set sometimes changes the tension on the fibers and causes the entire cylinder to flex.

As a result, the total amount of irregularities in the surface, including both irregularities caused by fiber overlapping and the like and irregularities caused by flexing of the entire cylinder, is sometimes instead worse than before removal machining. The example of FIG. 7 shows a simulation of the total amount of irregularities in the surface when the thickness of the outermost layer is changed in the same configuration as the present example, in both a case of the machining nonuniformity (thickness nonuniformity in the inside layers) being comparatively small (0.05 mm) and a case of the machining nonuniformity being comparatively large (0.07 mm). As a result, the total amount of irregularities in the surface is greater than before removal machining when the thickness of the outermost layer is small after removal machining, but another result is that the total amount of irregularities in the surface decreases when the thickness of the outermost layer after removal machining is increased. For example, when the machining nonuniformity is 0.07 mm and the thickness of the outermost layer after removal machining is 0.1 mm, the total amount of irregularities in the surface after removal machining increases up to 0.35 mm, but the total amount of irregularities in the surface can be reduced to 0.17 mm when the thickness of the outermost layer after removal machining is 1.6 mm. The amount of irregularities in the surface is less than before machining (with a certain amount of leeway) but is approximately 0.5 mm (other layers: 1.25 times 0.4 mm), and it is therefore presumable that the thickness after surface removal is preferably greater than the other layers by at least 25%.

By setting the thickness of the outermost hoop layer 5 as described above, even if there is nonuniformity in the amount of fibers removed by removal machining, it is possible to relatively reduce nonuniformity in internal stress caused by the release of internal strain originating from nonuniformity in the amount of fibers removed during removal machining, the flexing of the rotating cylinder portion 3 made of a fiber-reinforced resin is consequently reduced, the gap between the rotating cylinder and the fixed cylinder can thereby be made sufficiently small (e.g., about 1 mm, comparing favorably with cylinders made of metal), and exhaust performance can thereby be improved. It is also possible to relatively reduce the effects of cutting of continuous fibers, undoing of the flexing balance between an anisotropic material layer and another anisotropic material layer, and changes in the tension on the fibers of predetermined portions of the layers, originating from nonuniformity in the amount of fibers removed during removal machining, and the same effects as described above can be achieved.

Figure 5:
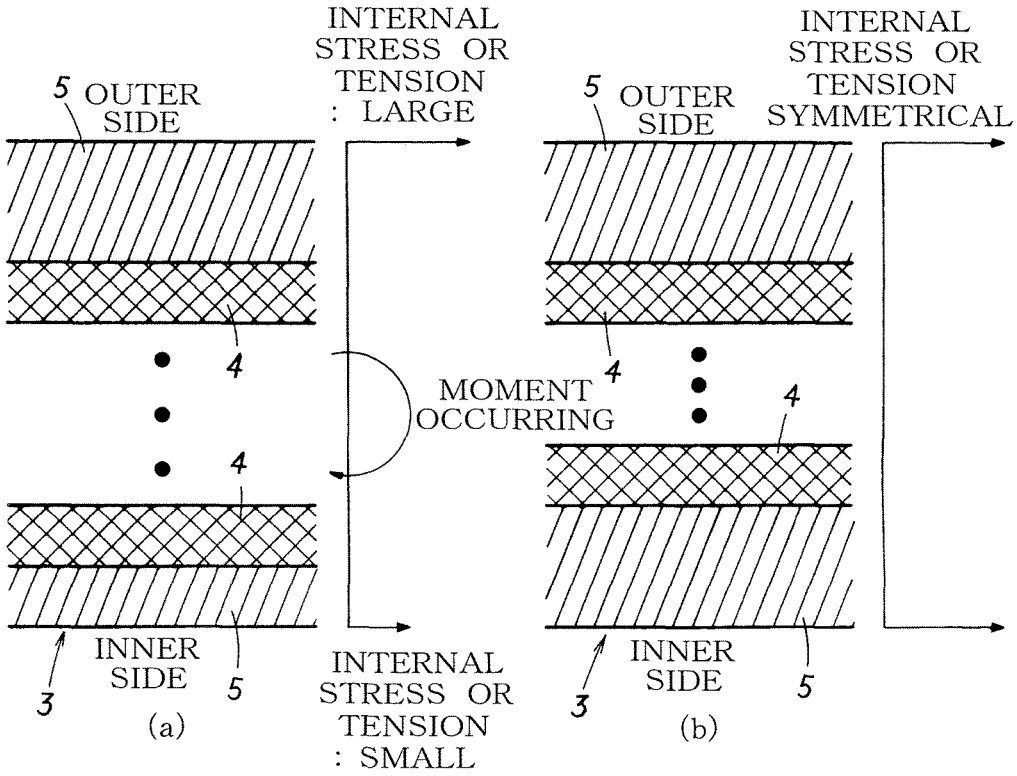
FIG. 5 is a schematic explanatory cross-sectional view of the rotating cylinder portion of the present example.

Furthermore, the innermost layer and the outermost layer may be of equal to each other in thickness (the configuration may be such that the outermost layer and the innermost layer have the maximum thickness). This is because, as shown in FIG. 5, the internal stress is more symmetrical inside to outside, the occurrence of moments can be better prevented, and internal stress can be better dispelled when the outermost layer and innermost layer are equal to each other in thickness (symmetrical) (b), in comparison to when the outermost layer and the innermost layer are not equal to each other in thickness (a). It is also possible to relatively reduce the difference in inner and outer tension caused by changes in tension in predetermined portions due to removal machining. In this case, the outermost layer and the innermost layer are at least 25% thicker than the layers other than the outermost layer and the innermost layer (layers of minimum thickness). The circularity (shape) of the rotating cylinder portion 3 can thereby be maintained even if the outermost layer is thinned by removal machining.

Figure 6:
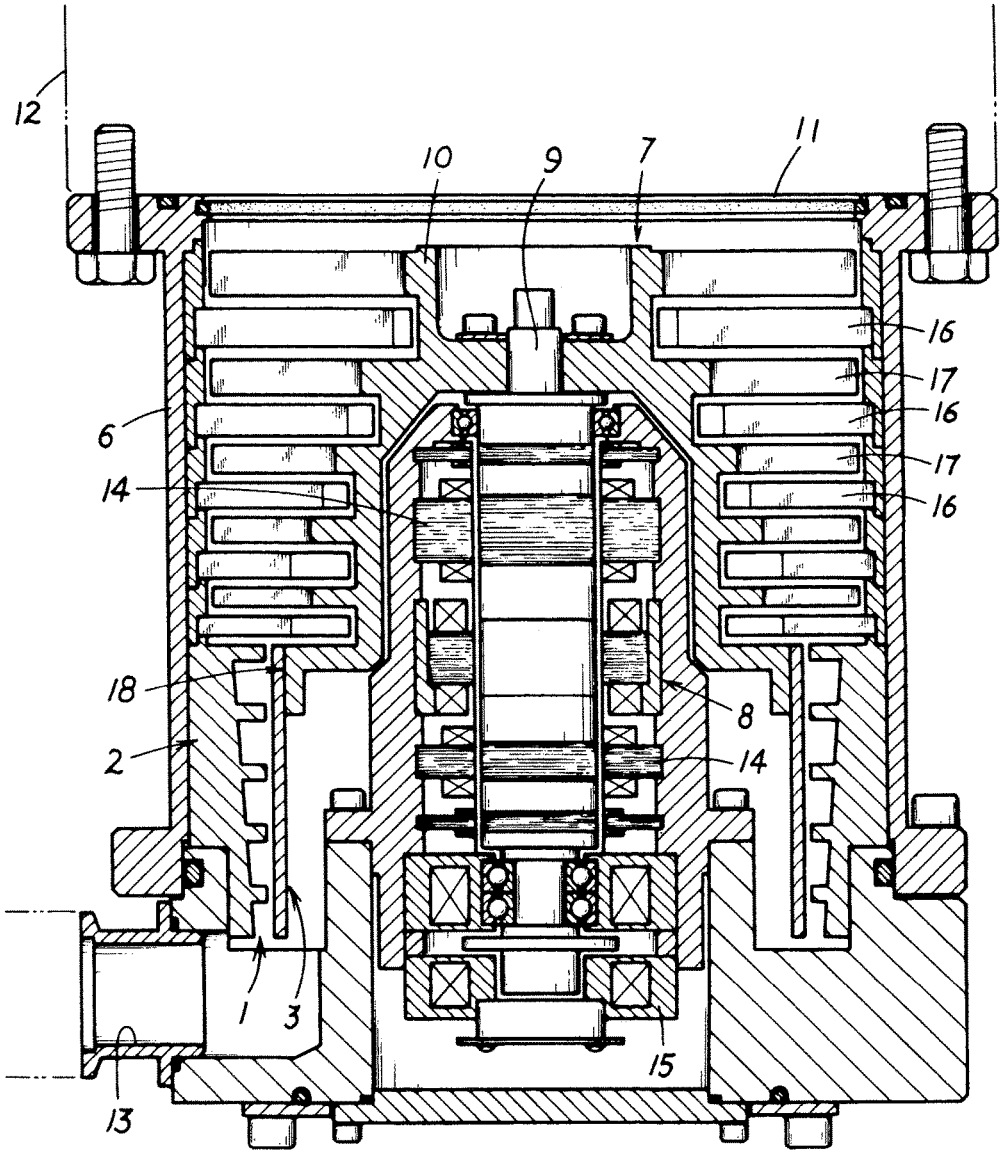
FIG. 6 is a schematic explanatory cross-sectional view of another example of the present example.

The present example describes a thread groove pump, but with a compound turbo-molecular pump or the like such as that of the other example shown in FIG. 6, the above-described configuration can be similarly employed if the pump has a thread groove pump portion. In this drawing, the symbols 16 indicate fixed blades protruding from the inner wall surface of the pump case 6 at numerous levels and predetermined gaps apart, the symbols 17 indicate rotating blades placed alternately with the fixed blades 16 (and provided integrally to the metal attachment part 10 attached to the rotating shaft 9 of the DC motor 8), and an annular fitting part 18 provided in the bottom end of the attachment part 10 is connected in a fitted manner to the rotating cylinder portion 3 by cold fitting. The excess is the same as in the case of FIG. 1.

Because the present example is configured as described above, the flexing of the rotating cylinder portion 3 made of a fiber-reinforced resin can be reduced as much as possible to sufficiently reduce the gap between the rotating cylinder portion 3 and the fixed cylinder portion 2, and exhaust performance can thereby be improved to great effect.

The invention claimed is:

1. A vacuum pump comprising:

a thread groove pump portion having a fixed cylinder portion with a spiraling thread groove portion provided in an internal peripheral surface, and a rotating cylinder portion disposed inside the fixed cylinder portion, the thread groove pump portion exhausting through a spiraling exhaust flow channel due to the rotating cylinder portion being caused to rotate, the spiraling exhaust flow channel being formed from the thread groove portion and an external peripheral surface of the rotating cylinder portion, wherein the rotating cylinder portion comprises at least two fiber-reinforced resin hoop layers and a fiber-reinforced resin helical layer interposed between the at least two fiber-reinforced resin hoop layers, wherein an outermost one of the at least two fiber-reinforced resin hoop layers is configured to be thicker than an adjacent fiber-reinforced resin helical layer, wherein the rotating cylinder portion includes a removal machining portion on at least part of the external peripheral surface of the rotating cylinder portion.

2. The vacuum pump according to claim 1, characterized in that the outermost fiber-reinforced resin hoop layer is configured to be at least 25% thicker than an adjacent layer.

3. The vacuum pump according to claim 1, wherein irregularities on at least part of the surface of the rotating cylinder portion are less than 0.25 mm.

4. The vacuum pump according to claim 1, wherein the at least two fiber-reinforced resin hoop layers are equal to each other in thickness.

5. The vacuum pump according to claim 1, wherein the rotating cylinder portion further comprises an additional fiber-reinforced resin hoop layer and an additional fiber-reinforced resin helical layer, and layers other than the outermost fiber-reinforced resin hoop layer and an innermost fiber-reinforced resin hoop layer are set to be equal to each other in thickness.

6. A vacuum pump comprising:

a thread groove pump portion having a fixed cylinder portion with a spiraling thread groove portion provided in an internal peripheral surface, and a rotating cylinder portion disposed inside the fixed cylinder portion, the thread groove pump portion exhausting through a spiraling exhaust flow channel due to the rotating cylinder portion being caused to rotate, the spiraling exhaust flow channel being formed from the thread groove portion and an external peripheral surface of the rotating cylinder portion, wherein the rotating cylinder portion comprises a plurality of fiber-reinforced resin layers, and the fiber-reinforced resin layers include helical layers comprising a helical winding of fibers and hoop layers comprising a hoop winding of fibers, and an outermost hoop layer is configured to be thicker than an adjacent layer, wherein the rotating cylinder portion includes a removal machining portion on at least part of the external peripheral surface of the rotating cylinder portion.

7. The vacuum pump according to claim 6, wherein the outermost hoop layer is configured to be at least 25% thicker than the adjacent layer.

8. The vacuum pump according to claim 6, wherein irregularities on at least part of the surface of the rotating cylinder portion are less than 0.25 mm.

9. The vacuum pump according to claim 6, wherein the outermost layer of the rotating cylinder portion is a hoop layer.

10. The vacuum pump according to claim 6, wherein an innermost layer of the rotating cylinder portion is a hoop layer.

11. The vacuum pump according to claim 10, wherein the hoop layers of the outermost layer and innermost layer of the rotating cylinder portion are equal to each other in thickness.

12. The vacuum pump according to claim 6, wherein layers of the rotating cylinder portion other than the outermost layer and innermost layer are set to be equal to each other in thickness.

13. A vacuum pump comprising:

a thread groove pump portion equipped with a fixed cylinder portion having a spiraling thread groove portion provided in an internal peripheral surface;

a rotating cylinder portion placed inside the fixed cylinder portion, the thread groove pump portion exhausting through a spiraling exhaust flow channel due to the rotating cylinder portion being caused to rotate;

wherein the spiraling exhaust flow channel is formed from the thread groove portion and an external peripheral surface of the rotating cylinder portion;

wherein the rotating cylinder portion comprises a first fiber-reinforced resin layer and a second fiber-reinforced resin layer;

wherein the first fiber-reinforced resin layer provides more resistance to force in a circumferential direction than the second fiber-reinforced resin layer, and the second fiber-reinforced resin layer provides more resistance to force in an axial direction than the first fiber-reinforced resin layer, wherein the rotating cylinder portion includes a removal machining portion on at least part of the external peripheral surface of the rotating cylinder portion.

14. The vacuum pump according to claim 13, wherein the first fiber-reinforced resin layer is thicker than the second fiber-reinforced resin layer.

15. The vacuum pump according to claim 13, further comprising at least one additional first fiber-reinforced resin layer and at least one additional second fiber-reinforced resin layer.

* * * * *